US010060260B2

(12) United States Patent
Nystrom

(10) Patent No.: US 10,060,260 B2
(45) Date of Patent: Aug. 28, 2018

(54) ARRANGEMENT AND METHOD FOR POSITIONING CARTRIDGES FOR A ROCK GROUTING EQUIPMENT

(71) Applicant: Atlas Copco Rock Drills AB, Orebro (SE)

(72) Inventor: Sven-Olov Nystrom, Orebro (SE)

(73) Assignee: Epiroc Rock Drills Aktiebolag, Orebro (SE)

( * ) Notice: Subject to any disclaimer, the term of this patent is extended or adjusted under 35 U.S.C. 154(b) by 360 days.

(21) Appl. No.: 14/894,399

(22) PCT Filed: Jun. 25, 2014

(86) PCT No.: PCT/SE2014/050785
§ 371 (c)(1),
(2) Date: Nov. 27, 2015

(87) PCT Pub. No.: WO2014/209211
PCT Pub. Date: Dec. 31, 2014

(65) Prior Publication Data

US 2016/0115789 A1 Apr. 28, 2016

(30) Foreign Application Priority Data

Jun. 26, 2013 (SE) ..... 1350774

(51) Int. Cl.
*E21D 20/00* (2006.01)
*E21D 20/02* (2006.01)

(52) U.S. Cl.
CPC ..... *E21D 20/006* (2013.01); *E21D 20/02* (2013.01); *E21D 20/023* (2013.01); *E21D 20/028* (2013.01)

(58) Field of Classification Search
CPC ..... E21D 20/00; E21D 20/006; E21D 20/028; E21D 20/023; E21D 20/02
See application file for complete search history.

(56) References Cited

U.S. PATENT DOCUMENTS 3,104,584 A 9/1963 Jacobs
5,114,279 A * 5/1992 Bjerngren ..... E21D 20/006 405/259.1
5,246,313 A * 9/1993 Combet ..... E21D 20/006 173/192
5,791,822 A 8/1998 Edmondson et al.
(Continued)

FOREIGN PATENT DOCUMENTS

CN 2929189 8/2007
EP 1916381 4/2008
(Continued)

*Primary Examiner* — Michael R Wills, III
(74) *Attorney, Agent, or Firm* — Mark P. Stone

(57) ABSTRACT

Arrangement (10) for a rock grouting equipment for positioning at least one cartridge (11) is described. The arrangement incorporates at least one magazine (12), arranged around an axis (15). The magazine (12) incorporates at least one space (13), in which space (13) a plurality of said cartridges (11) is stored. The arrangement further incorporates at least one, radially extending, catching device (3, 14), arranged and formed such that it catches at least one cartridge (11) between itself and the inner surface (4) of the magazine body (12), when it performs a rotating movement around the axis (15). The invention also relates to a method.

19 Claims, 4 Drawing Sheets

(56) References Cited

U.S. PATENT DOCUMENTS

| | | | |
|---|---|---|---|
| 6,390,189 | B1 | 5/2002 | Tienari et al. |
| 2008/0145152 | A1 | 6/2008 | Brongniart et al. |

FOREIGN PATENT DOCUMENTS

| | | |
|---|---|---|
| WO | WO 99/36674 | 7/1999 |
| WO | WO 99/64722 | 12/1999 |
| WO | WO/01 11193 | 2/2001 |
| WO | WO 03/004821 | 1/2003 |

* cited by examiner

ARRANGEMENT AND METHOD FOR POSITIONING CARTRIDGES FOR A ROCK GROUTING EQUIPMENT

TECHNICAL FIELD

The present invention relates to an arrangement and a method for a rock grouting equipment for positioning of at least one cartridge.

BACKGROUND

For rock reinforcement often two-component resin with hardener is used to fix rock bolts introduced as reinforcement in bored holes in the rock. The resin is supplied in the form of cartridges where the non-hardened resin is enclosed in an outer cover and where hardener in turn is enclosed in a separate part inside the cover. After a suitable number of resin cartridges have been introduced in a borehole a rock bolt is introduced during rotation whereby the cover of the cartridges is teared apart and the non-hardened resin is mixed with the hardener. The rotation of the rock bolt is proceeded until the two-component resin starts harden. The rock bolt will thereby be fixed in its position in the bore hole.

Earlier known arrangements to load a borehole with this type of cartridges often comprises a grouting nozzle with a tube which is brought to abut the borehole to be loaded with cartridges. From this tube a flexible hose leads to a loading tube placed adjacent to a rock drilling equipment. One or several cartridges is placed in loading position in the loading arrangement. Thereafter a pressure medium is supplied to the loading tube and the one, or several, in loading position placed cartridge is fired by the pressure medium through the flexible hose via the grouting nozzle and into the borehole to be loaded. The cartridges are placed manually in firing position in the loading arrangement.

Manual handling of this type of cartridges shall as far as possible be avoided since the two-component resin is very insanitary. Several proposed solutions for automatically feed and fire this type of cartridges have been proposed. This type of cartridges is however difficult to handle since their outer cover is relatively soft and they thereby have a kind of formless shape. Another problem with the soft cover is that the cartridges relatively easy may tear apart. A comprehensive cleaning of the feeding means from spilled both non-hardened and hardened resin is then necessary which generally causes a longer stop in operation. Further, variations in the size of the cartridges may occur which further causes problem. The surface of the cartridges is also of such nature that they may easy adhere to each other which also causes problem when automatically feeding.

U.S. Pat. No. 6,390,189 is an example of automatically feeding means for cartridges intended to be used with a rock drilling equipment. The known arrangement comprises a rotatable cartridge storehouse provided with a plurality of loading tubes arranged along with the periphery of the storehouse. The cartridge storehouse may be loaded in advance with a large number of cartridges. The storehouse is thereafter rotated stepwise whereby one in a loading tube placed cartridge is brought into firing position. By applying compressed air to the loading tubes, the cartridge is fired away from the loading tube via a connecting hose positioned in the firing direction and further into a bore hole.

The known arrangement however shows a plurality of disadvantages. Many separate loading tubes makes the design large, heavy and clumsy, and expensive and complicated to manufacture. Further, it does not manage to handle cartridges of different dimensions. If a cartridge tears apart, the storehouse with its complex design is difficult to clean with long down time following. The design further causes that the cartridges must be handled one by one when loading the storehouse.

Another example of automatically feeding means is shown in US 2008/0145152. The known arrangement comprises one or several containers comprising cartridges arranged horizontally laying on each other, and placed above a loading area being in connection with a firing area for the cartridges. Between each container and the loading area is a rotating distributor arranged to move the cartridges one by one.

The V-shaped designed containers which uses gravity for feeding causes that a cartridge is exposed to large weight from above laying cartridges when the storehouse is loaded with many cartridges. During feeding the cartridge is at the same time exposed to friction against the sides of the design and to the above and below placed cartridges. This causes a risk that some of the cartridges tears apart with subsequent down time. The design is complex with both fixed and movable parts which makes it difficult to clean.

A further known arrangement is shown in WO 99/64722. Also in this design cartridges is fed with help from gravity. The cartridges that is located far down are thus also in this feeding means exposed to large weight from above placed cartridges and to friction against the sides of the design and from above and below placed cartridges. The design is complex and comprises movable parts which makes it complicated to manufacture and difficult to clean.

SUMMARY

A purpose is to provide an arrangement that at least in part solves the problems mentioned above. This purpose is according to one aspect obtained by an arrangement for a rock grouting equipment for positioning at least one cartridge. The arrangement comprises at least one storehouse arranged around an axis and intended to comprise a plurality of said cartridges. The storehouse comprises at least one tray, in which tray a plurality of cartridges are placed. Thus a stack of cartridges may be placed in said at least one tray, and these cartridges may move freely in the tray since they are not placed in separate loading tubes. The arrangement further comprises at least one in relation to the axis in radial direction extending catching organ. The catching organ is arranged to perform a rotating movement around the axis. The catching organ is arranged to, during said rotating movement, catch at least one of said cartridges.

According to another aspect a method in such arrangement is provided. The method comprises rotating said catching organ around the axis and catching at least one of said cartridges during said rotating movement.

DETAILED DESCRIPTION

Exemplified embodiments will now be described more in detail with reference to the attached figures. The same number in the figures refers throughout to the same element. Note that the figures not necessary are made to scale and that some details may have been exaggerated for clarity reasons.

Figure 1:
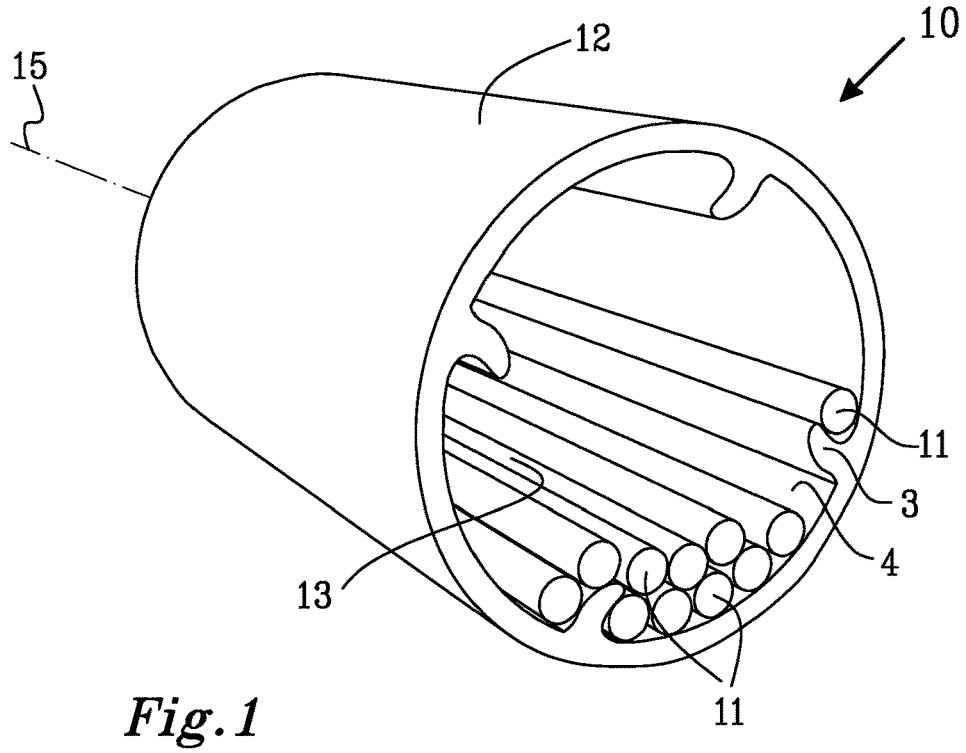
FIG. 1 is a view of one embodiment of the arrangement.

FIG. 1 shows an embodiment of an arrangement 10 for a rock grouting equipment for positioning of at least one cartridge. The arrangement comprises a storehouse 12 arranged around an axis 15 and intended to comprise a plurality of cartridges 11. The storehouse 12 is shown in the figure with a substantially cylindrical form but may as well have some other around the axis 15 arranged arbitrary form for example with hexagonal or polygonal cross section. The storehouse 12 comprises at least one compartment 13 in which a plurality of cartridges 11 are placed. The arrangement 10 comprises also at least one in relation to the axis 15 in radial direction extending catching organ, in the example shown in the figure formed like longitudinal ridges 3 formed in the inner surface of the storehouse. Respective ridge 3 may extend along the whole length of the storehouse 12, or along a part of the length of the storehouse, or be divided in several separate parts.

The catching organ comprises thus one or several in parallel with the axis extending ridges 3 arranged in the inner surface area 4 of the storehouse. The ridges 3 are arranged to perform a rotating movement around the axis 15 by that the storehouse 12 is brought into a rotating movement around the axis 15. The in the storehouse 12 placed cartridges 11 will then slip along the inner surface area 4 of the storehouse and the catching the means. The ridges 3 are arranged to, during said rotating movement, catch at least one of said cartridges 11. If a flowing medium, like water, is added to the storehouse 12 in order to decrease the friction between the cartridges 11 and between the cartridges 11 and the inner surface area 4 of the storehouse, the flow is facilitated if the ridge is divided in several parts.

Figure 2:
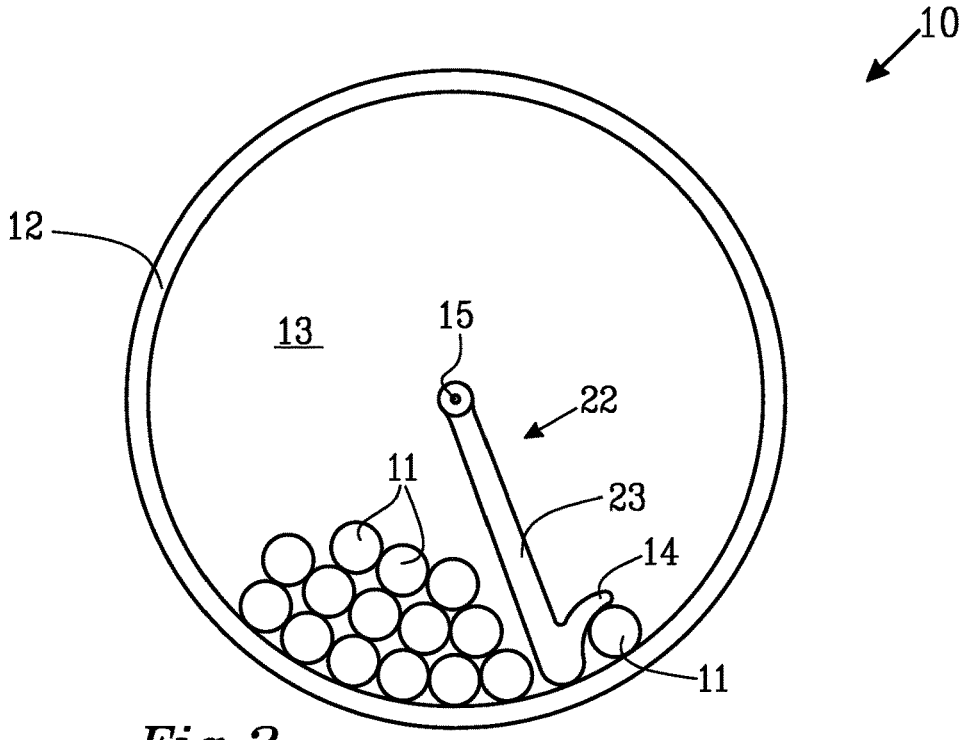
FIG. 2 is a view of an alternative embodiment of the arrangement.

FIG. 2 shows another embodiment of an arrangement 10 for feeding cartridges 11 seen from the front. The arrangement comprises a storehouse 12 intended to comprise a plurality of cartridges 11. The storehouse 12 comprises a compartment 13, in which compartment a plurality of cartridges is placed. A rotor 22 provided with one in relation to the axis 15 radially extending rotor blade 23 is arranged to be placed inside the storehouse 12. Further, catching organ is comprised in form of that the rotor blade 23 has been provided with convey means such as the conveyor 14. The rotor blade 23 is arranged to perform, around an axis 15, one in relation to the storehouse 12 rotating movement. The axis 15 may have any direction. In the example shown in the figure a substantially horizontally arranged axis 15 is shown.

When the rotor blade 23 is brought into rotating movement around the axis 15 the cartridges 11 will slip on the inner surface area 4 of the storehouse 12. The conveyor 14 will then, during said rotating movement, catch at least one of the cartridges 11. The catching organ, in the figure shown as conveyor 14, is arranged to place at least one cartridge 11 in a predetermined position, for example but not necessary at the periphery of the storehouse. The rotor blade 23 may be brought to stay in a specific position, and is preferably fixed in said specific position. From the predetermined position may the cartridge, or the cartridges, be moved to a loading position for firing, for example with help from a linear actuator that pushes the cartridge, or the cartridges, in a direction in parallel with the axis 15 in a firing arrangement, i.e. a firing hose (not shown in figure). Alternatively, the cartridge or cartridges may be fired directly from said specific position.

Figure 3:
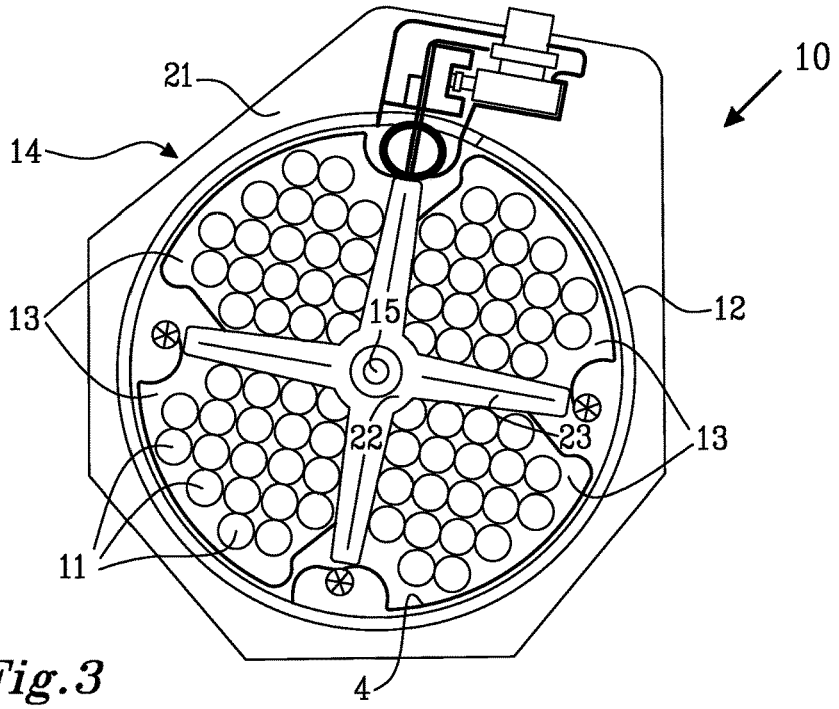
FIG. 3 shows a further embodiment of the arrangement seen from the front.

FIG. 3 shows a further embodiment of an arrangement 10 for feeding of cartridges 11 seen from the front. The arrangement comprises a storehouse 12 intended to comprise a plurality of cartridges 11 in several separated trays 13. A rotor 22 with several rotor blades 23 is arranged in the storehouse 12, wherein the rotor blades 23 form delimitations for the compartments 13 where the cartridges 11 are placed. In respective compartment 13 a plurality of cartridges 11 is placed. The rotor 22 is arranged to perform a rotating movement around the axis 15. When the rotor 22 is brought into rotating movement around the axis 15 the cartridges 11 in the compartments 13 will slip on the inner surface area 4 of the storehouse 12. The rotor blades 23 are provided with conveyors 14 that will, during said rotating movement, catch at least one of the cartridges 11. The conveyors 14 are arranged to place the cartridge, or the cartridges, 11 in a predetermined position. The rotating movement of the rotor 22 may be stopped and the rotor may be fixed and locked in at least one certain position. From the predetermined position may the cartridge, or the cartridges 11, be moved to a loading position for firing, or be fired directly.

Figure 4:
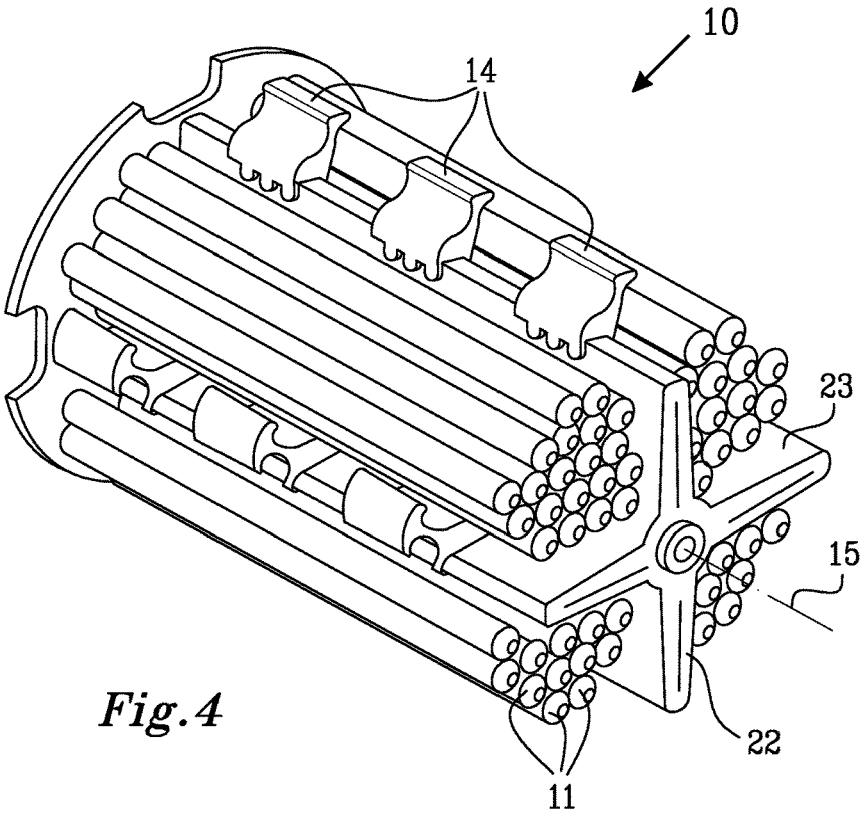
FIG. 4 is a perspective view of an embodiment of the arrangement.

FIG. 4 is a perspective view of an embodiment of an arrangement 10 for feeding resin cartridges. A plurality of conveyors 14 are arranged in the periphery part of the rotor blades 23. The position of the conveyors 14 in a radial direction may be adjusted. Since the exact position of the conveyors 14 may be adjusted individually, the horizontal position of the one or several caught cartridges may be tuned. In the figure is also an occlusive cover 43 shown. To decrease the friction between the individual cartridges 11 and between the cartridges 11 and the inner surface area of the storehouse 12, the storehouse 12 may in part be filled with some friction reducing medium. This medium may be any that decreases the friction, for example may water or water mixed with soap be used.

Figure 5:
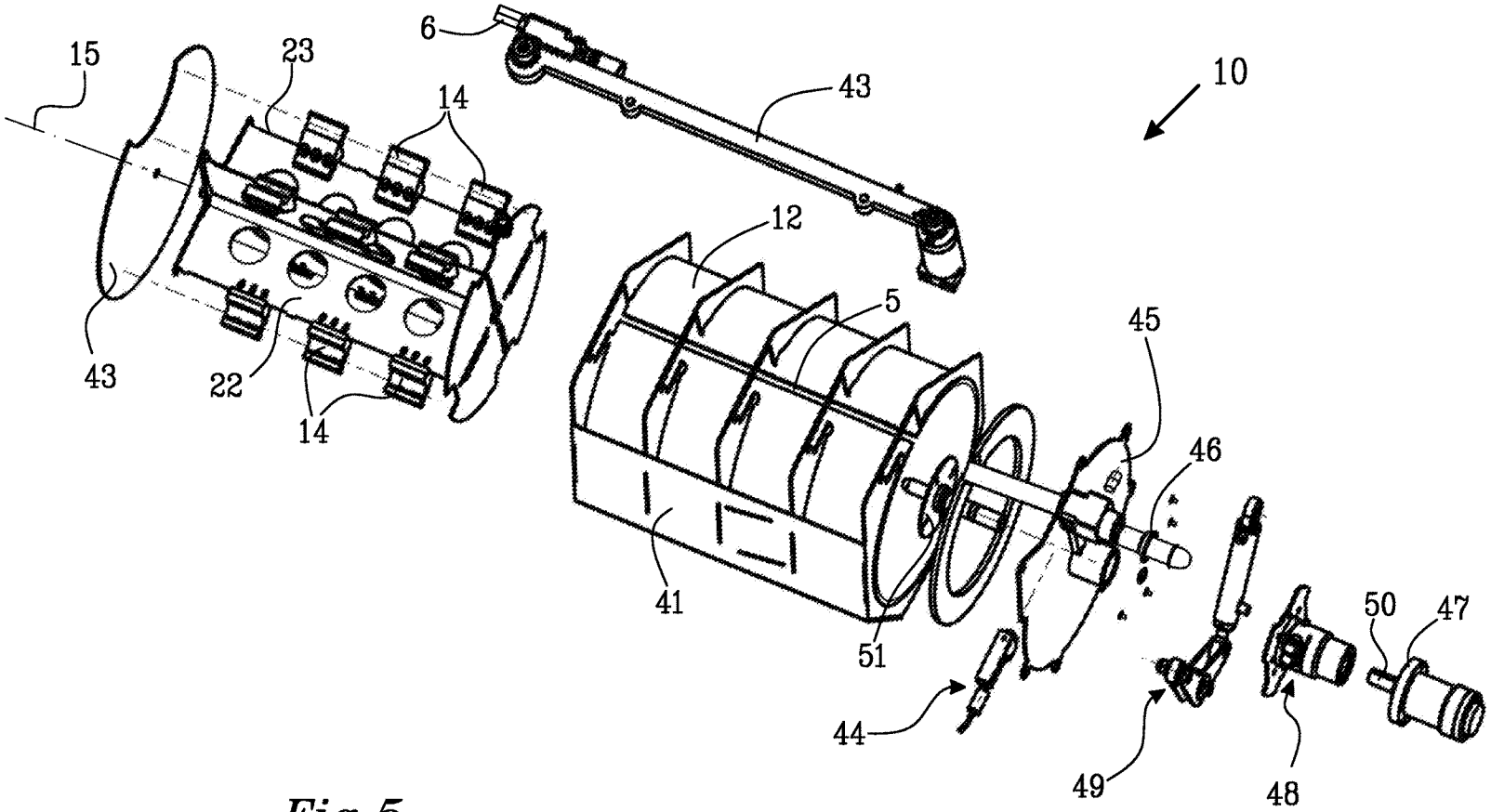
FIG. 5 is an exploded view of an embodiment of the arrangement.

FIG. 5 is a detailed exploded view of an exemplified embodiment of an arrangement 10 for a rock grouting equipment intended for automatically feeding and positioning a large number of cartridges 11, for example 50-100 cartridges. The arrangement comprises at least one substantially cylindrically shaped storehouse 12 intended to comprise a plurality of cartridges 11. The storehouse is arranged rotatable symmetrical around one substantially horizontal axis 15 and is at least in part enclosed by a frame 41.

A rotor 22 is arranged to be placed inside the storehouse 12. From the central axis of the rotor one or several rotor blade 23 extends. In the example shown in the figure the rotor 22 is provided with four rotor blades 23. When the rotor 22 is placed inside the storehouse 12 the rotor blades 23 forms in radial direction extending delimitations whereby four of the by the rotor blades 23 separated compartments 13 for placing of cartridges 11 is formed. The rotor 22 is arranged to perform, around the substantially horizontally arranged axis 15, one in relation to the storehouse 12 rotating movement. The rotor 22 is driven by a driving engine 47 which transfers torque to the rotor 22 via a drive shaft 50 and a driving arrangement 51. At the periphery edge of the rotor blade 23 is one or several conveyors 14 arranged. In the example shown in the figure the rotor blades 23 are provided with three conveyors 14.

The conveyor 14 is arranged to, during said rotating movement, catch one or several of the cartridges 11. When the rotor 22 is rotated the in the compartments 13 placed cartridges 11 will slip on the surface area of the storehouse 12. The inner surface area of the storehouse 12 is provided with a surface which provides a smooth surface with low friction against which surface the in the storehouse 12 placed cartridges 11 may easy slip. The smooth surface may for example be a polyurethane surface. The arrangement 10 may be provided with an occlusive lock 43. To further decrease the friction between the cartridges 11 and the inner surface area of the storehouse 12 may the storehouse 12 in part be filled with some friction decreasing medium, for example water.

This also decreases the friction between the cartridges 11 placed in the storehouse and the risk that the cartridges adhere to each other or to the inner surface of the storehouse decreases. Thus, the risk that some cartridge tears apart decreases. During the rotating movement the against the surface area of the storehouse slipping cartridges will be caught by the convey means 14. The rotating movement of the rotor 22 proceeds until one in advance specific position where the position of the rotor 22 may be fixed with a locking arm 49. The arrangement further comprises an indexing disc 48.

The conveyors 14 are arranged in the periphery part of the rotor blades 23. The position of the conveyors 14 in radial direction may be adjusted. Since the exact position of the conveyors 14 may be adjusted individually, the horizontal position of the one or several caught cartridges may be tuned. The arrangement 10 is provided with a connection 46 to one or several firing arrangements like one or several firing hoses (not shown in figure). The arrangement 10 further comprises an actuator 42 arranged to move the cartridge, or the cartridges, 11 from the predetermined position to an adjacent to the storehouse 12 arranged firing arrangement like a firing hose (not shown). The actuator 42 is arranged to act linear in a direction substantially in parallel with the axis 15.

When the cartridge, or the cartridges, 11 is positioned they are moved with help from the actuator 42 from the storehouse 12 to the firing hose. The linear actuator 42 is arranged to act in a direction along with the axis 14 and to slip in a cut groove 5 in the storehouse 12 with help from a driving mechanism 6. The actuator 42 will thus push the one or several positioned cartridges 11 out from the storehouse 12 and into the firing hose. In this way one or several cartridges 11 may be placed in the firing hose. A sensor 44 may indicate that one or several cartridges have been placed in the firing hose. The sensor 44 may be any sensing sensor, for example a photocell, or a sensor that senses weight. The rotating movement and the steps above are repeated until a desired number of cartridges 11 are placed in the firing hose. The actuator 42 is arranged to seal the opening of the firing hose turned towards the storehouse 12. For this purpose the actuator 42 may for example have a circular cross section and may be provided with a conical tapered form, or with a sealing membrane. When the end of the firing hose is sealed gas, for example compressed air, is applied to the firing hose via a connection 45 whereby the cartridges 11 are fired.

Figure 6:
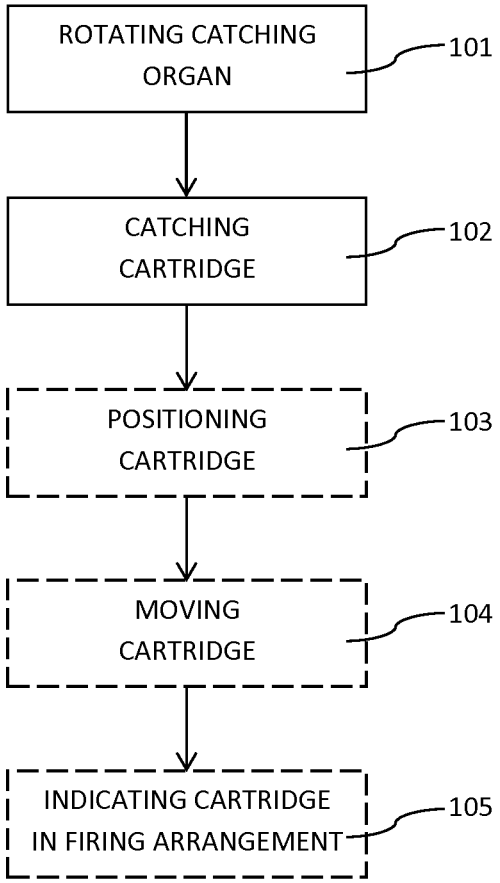
FIG. 6 is a flow chart showing an exemplified method.

FIG. 6 is a flow chart showing an exemplified method. The method is performed in an arrangement 10 for a rock grouting equipment as described according to any of the examples above. The method comprises rotating 101 catching organ 3, 14 around an axis 15. At least one cartridge 11 is caught 102 by the catching organ 3, 14 during the rotating movement. The method further comprises positioning 103 at least one caught cartridge 11 in a predetermined position. The catching organ 3, 14 may comprise one or several convey means 14 which position in radial direction may be adjusted. The positioning 103 of the one or several caught cartridges 11 may be adjusted by adjusting the position in radial direction of the one or several conveyors. The method may further comprise moving 104 the cartridge, or the cartridges, 11 from the predetermined position to one, or several, adjacent to the storehouse 12 arranged firing hoses. Moving 104 may occur linear in a direction substantially in parallel with the axis 15. The method may further comprise indicating 105 presence of one or several cartridges 11 in said firing hose by a sensor 44.

The above exemplified arrangements and the methods show a plurality of advantages. The robust design enables a compact and light weight arrangement. The design shows few parts which partially may be taken apart which facilitate cleaning. Refill of cartridges is simple and the arrangement has capacity to handle many cartridges. Further, cartridges with the same hardening time or the same dimensions may be placed in different trays if desired. The arrangement does not require the same advanced control equipment like earlier known designs.

The skilled person within the field realizes that embodiments described above may be combined. Thus, the invention is not limited to the described embodiments. The invention is limited only by the patent claims defining the scope of protection.

The invention claimed is:

1. An arrangement (10) for a rock grouting equipment for positioning at least one cartridge (11), wherein the arrangement comprises:

at least one storehouse (12) arranged around a substantially horizontally arranged axis (15) for holding a plurality of said cartridges (11), said storehouse (12) comprising at least one compartment (13), wherein said at least one compartment is adapted to receive a plurality of said cartridges (11) placed therein, at least one catching organ (3, 14) extending in a radial direction relative to the horizontally arranged axis (15), wherein said catching organ (3, 14) is arranged to perform a rotating movement around the horizontally arranged axis (15), and wherein said catching organ (3,14) is arranged and formed such that the catching organ, during said rotating movement, catches at least one of said cartridges between the catching organ (3,14) and an inner surface (4) of the storehouse body (12).

2. The arrangement according to claim 1, wherein said catching organ (3, 14) is arranged to place at least one cartridge (11) in a predetermined position.

3. The arrangement according to claim 2, further comprising an actuator (42) arranged to move said at least one cartridge (11) from said predetermined position to an adjacent to the storehouse (12) arranged firing arrangement.

4. The arrangement according to claim 3, wherein the actuator (42) is arranged to act linear in a direction substantially in parallel with the axis (15).

5. The arrangement according to claim 3, wherein said actuator (42) is arranged to seal the opening of the firing arrangement which is turned towards the storehouse (12).

6. The arrangement according to claim 3, further comprising a sensor (44) arranged to indicate the presence of a cartridge (11) in said firing arrangement.

7. The arrangement according to claim 1, further comprising a rotor (22) provided with at least one in relation to the axis (15) radially extending rotor blade (23), wherein said rotor (22) is arranged to be placed inside the storehouse (12).

8. The arrangement according to claim 7, wherein said rotor (22) comprises several rotor blades (23), wherein the rotor blades (23) form delimitations for a plurality of trays (13) for placing cartridges (11).

9. The arrangement according to claim 7, wherein the catching organ (3, 14) comprises one or several conveyors (14) arranged in the periphery part of one or several of the rotor blades (23) for catching one or more of said cartridges (11).

10. The arrangement according to claim 9, wherein the position in radial direction of the one or several conveyors (14) is adjustable.

11. The arrangement according to claim 1, wherein said catching organ comprises one or several ridges (3) extending in parallel with the axis (15) and arranged in the inner surface area (4) of the storehouse.

12. The arrangement according to claim 11, wherein the storehouse (12) is arranged to rotate around the axis (15).

13. The arrangement according to claim 1, wherein the storehouse (12) is substantially cylindrically shaped.

14. A method in an arrangement (10) for a rock grouting equipment, wherein said arrangement comprises at least one storehouse (12) arranged around a substantially horizontally arranged axis (15) for holding a plurality of cartridges (11), said storehouse (12) comprising at least one compartment (13), wherein said at least one compartment is adapted to receive a plurality of said cartridges (11) placed therein, and at least one catching organ (3, 14) extending in a radial direction relative to the horizontally arranged axis (15), wherein the method comprises the steps of:

rotating (101) said catching organ (3, 14) around the substantially horizontally arranged axis (15), and catching (102) at least one of said cartridges (11) during said rotating movement by the at least one catching organs (3,14) between the catching organ and the inner surface (4) of the storehouse body (12).

15. The method according to claim 14, further comprising the step of:

positioning (103) said at least one caught cartridge (11) in a predetermined position.

16. The method according to claim 15, wherein the catching organ (3, 14) comprises one or several conveyors (14) for catching one or more of said cartridges (11), said method further comprising the step of adjusting the position of said one or several conveyors in a radial direction, wherein the positioning (103) of said at least one caught cartridge (11) is tuned by said adjusting of the position of the one or several conveyors in said radial direction.

17. The method according to claim 15, wherein the arrangement (10) further comprises an actuator (42), the method further comprising the step of:

moving (104) said at least one cartridge (11) from said predetermined position to an adjacent to the storehouse (12) arranged firing arrangement.

18. The method according to claim 17, wherein said moving (104) occurs linear in a direction substantially in parallel with the axis (15).

19. The method according to claim 14, wherein the arrangement (10) further comprises a sensor, the method further comprising the step of:

indicating (105) the presence of a cartridge (11) in said firing arrangement.

* * * * *